239-434 SR
10/22/85 OR 4,548,359

United States Patent [19]

Kriebel et al.

[11] Patent Number: 4,548,359

[45] Date of Patent: Oct. 22, 1985

[54] SELF-CLEANING GAS-LIQUID MIXING APPARATUS

[75] Inventors: John E. Kriebel, Souderton; Walton B. Jones, Richboro, both of Pa.

[73] Assignee: Capital Controls Company, Inc., Colmar, Pa.

[21] Appl. No.: 500,527

[22] Filed: Jun. 2, 1983

[51] Int. Cl.[4] ..... B05B 7/04

[52] U.S. Cl. ..... 239/434

[58] Field of Search ..... 239/434, 547, 588; 406/190, 192, 196

[56] References Cited

U.S. PATENT DOCUMENTS

| | | | |
|---|---|---|---|
| 2,683,622 | 7/1954 | Dragon | 299/84 |
| 3,375,032 | 11/1963 | Frantz | 239/113 X |
| 4,018,387 | 4/1977 | Erb et al. | 239/434 X |

FOREIGN PATENT DOCUMENTS

| | | | |
|---|---|---|---|
| 2950117 | 7/1981 | Fed. Rep. of Germany | 239/434 |
| 110585 | 8/1979 | Japan | 406/196 |
| 1132642 | 11/1968 | United Kingdom | 239/310 |
| 324076 | 11/1967 | U.S.S.R. | 234/112 |
| 663853 | 5/1979 | U.S.S.R. | 239/434 |
| 887381 | 11/1981 | U.S.S.R. | 406/191 |

*Primary Examiner*—Andres Kashnikow
*Assistant Examiner*—Kevin Weldon
*Attorney, Agent, or Firm*—Howson and Howson

[57] ABSTRACT

Apparatus particularly suited for use in mixing ammonia gas with hard water is disclosed. The apparatus includes an ejector assembly having a throat with a flexible tubular liner which is periodically flexed inwardly to loosen any solid matter which may have formed on the inside of the liner. The liner is flexed by a three-way valve connected to the water supply line and controlled by timers and a pressure switch. If desired, a similarly-lined tubular extension may be mounted downstream of the throat and flexed periodically to loosen any matter deposited therein. An orifice may be mounted in a diaphragm upstream of the throat to move in response to liner flexure for limiting solid matter accumulation adjacent the throat inlet.

20 Claims, 4 Drawing Figures

SELF-CLEANING GAS-LIQUID MIXING APPARATUS

FIELD OF THE INVENTION

The present invention relates to gas-liquid contacting apparatus, and more particularly, the present invention relates to self-cleaning apparatus particularly suited for mixing gaseous ammonia with hard water.

BACKGROUND OF THE INVENTION

Devices for mixing gases with liquids are known. In the typical mixing device, or ejector as they sometimes may be called, a flowing stream of fluid passing through a chamber between an orifice and a throat creates a vacuum which draws a gas from its source and mixes the same with the fluid flowing through the chamber. Such devices are used to mix gaseous chlorine with water in water treatment plants.

It has been found that when chlorine gas is mixed with water from certain sources, trihalomethanes can be formed. Trihalomethanes are suspected to be carcinogenic. Heretofore, the formation of trihalomethanes has been controlled by adding ammonia to the water to form amines, and thereafter adding chlorine. The chlorine combines with the amines to form chloramines which are not suspected to be carcinogenic.

Certain problems have been encountered in mixing ammonia with water in ejectors. For instance, when ammonia is mixed with water containing high proportions of certain minerals, such as calcium carbonate, solid precipitates tend to form in the throat, and this requires periodic cleaning of the ejector with concomitant downtime of the water treatment unit. Water softeners have been used to demineralize the water before it flows through the ejector and mixes with the ammonia. However, a major disadvantage of using softened water is in the initial cost to install the softening equipment and the cost to maintain the same.

OBJECTS OF THE INVENTION

With the foregoing in mind, a primary object of the present invention is to provide novel self-cleaning gas-liquid mixing apparatus.

It is another object of the present invention to provide an improved self-cleaning ejector which is particularly suited for use in mixing with a liquid, a gas having a tendency to react with the liquid to form precipitates capable of fouling the ejector.

A further object of the present invention is to provide a unique gas-liquid mixing system which is particularly suited for mixing gaseous ammonia with hard water in a manner which minimizes maintenance of the system.

A still further object of the present invention is to provide gas-liquid contact apparatus which is capable of operating for relatively long periods of time without fouling.

SUMMARY OF THE INVENTION

More specifically, the present invention provides apparatus which is particularly suited for mixing with a first flowing medium a second medium which causes a solid precipitate to form in the zone of mixing. The apparatus comprises an ejector assembly having a throat member with a through bore in which is mounted a flexible liner which cooperates with the bore to define therebetween an expandable chamber into which a working fluid is admitted for flexing the liner. Valving means operable in response to a timer and a pressure sensor controls the flow of working fluid to and from the chamber. If desired, a tubular extension having a flexible liner which is flexed inward simultaneously with the throat liner may be connected downstream of the throat. When flexed inwardly, each liner loosens any solid precipitate which may have formed thereon and allows the same to be discharged in the flow stream as it exits. Preferably, the ejector has an orifice mounted upstream of the throat in a flexible annular diaphragm which is flexed periodically in response to flexure of the liner to loosen any precipitate forming adjacent the orifice. The apparatus of the present invention is particularly suited for mixing gaseous ammonia with hard water with a minimum of maintenance.

BRIEF DESCRIPTION OF THE DRAWINGS

The foregoing and other objects, features and advantages of the present invention should become apparent from the following description, when taken in conjunction with the accompanying drawings, in which.

DETAILED DESCRIPTION OF THE INVENTION

Figure 1:
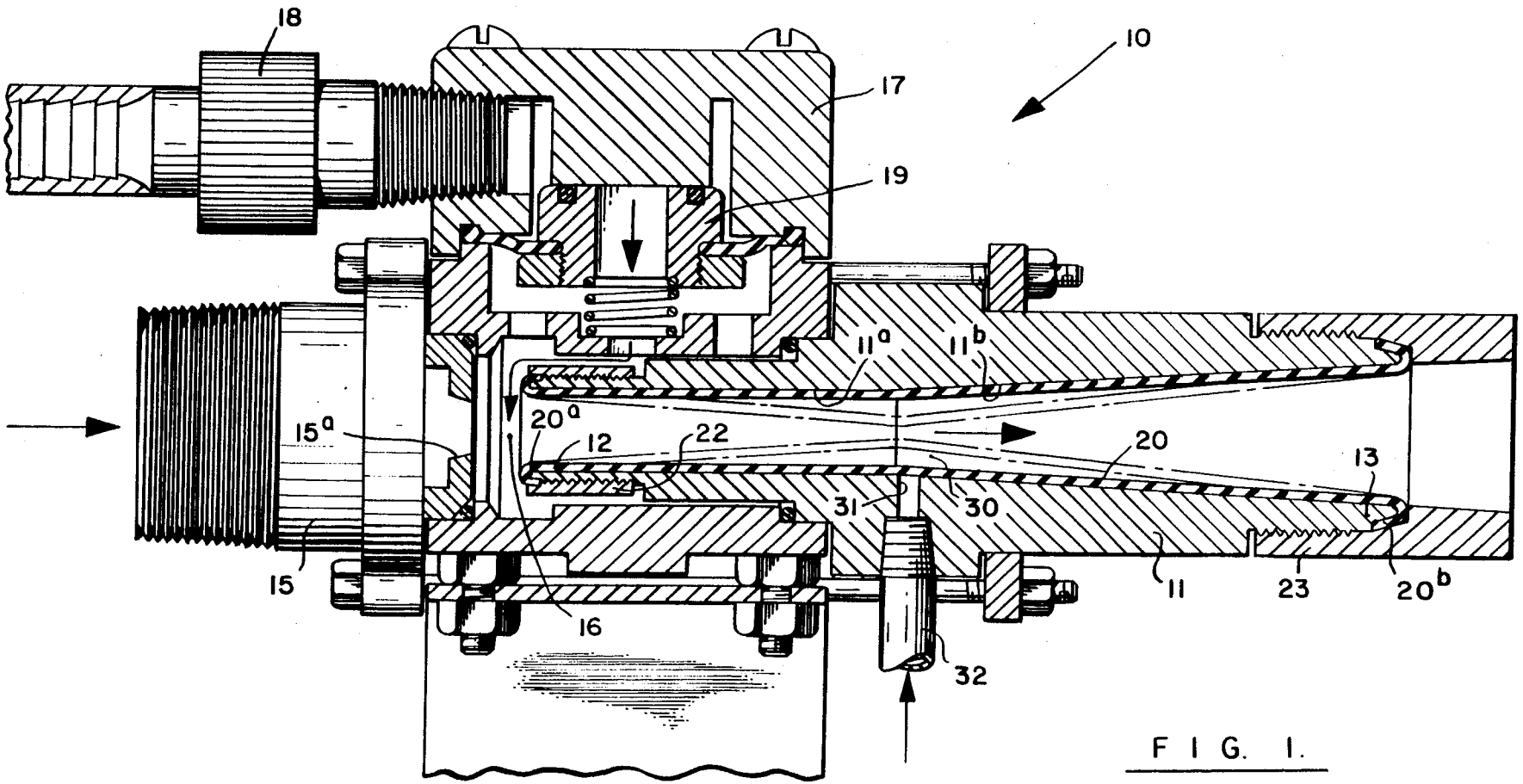
FIG. 1 is a longitudinal sectional view of self-cleaning gas-liquid mixing apparatus embodying the present invention.

Referring now to the drawings, FIG. 1 illustrates apparatus 10 of the present invention which is designed to mix a first flowing medium, such as hard water containing calcium carbonate, with a second medium, such as gaseous ammonia, in a manner which overcomes the problems caused by the tendency of the ammonia to cause the calcium carbonate in the water to form a precipitate which accumulates in the zone of mixing.

According to the present invention, the apparatus 10 comprises an ejector assembly having a throat member 11 with an upstream end 12 and a downstream end 13. The throat member has a central bore with a cylindrical portion **11*a* and a flared portion 11*b*** downstream thereof through which water flows in the direction indicated by the arrow. The throat member may be connected to a flexible conduit, or pipe (not shown) by any of various means.

The ejector assembly also includes a threaded inlet, or nipple, 15 provided upstream of the throat 11 for connection to a source of water under pressure. The nipple 15 has an internal orifice, or nozzle, **15*a* disposed in spaced confronting relation with respect to the upstream end 12 of the throat member 11 to define therebetween a mixing chamber 16 in which the ammonia is mixed with the water before entering the throat 11**.

Gaseous ammonia is supplied by a connection 18 to a check valve assembly 17 associated with the ejector. The check valve assembly 17 functions to allow the gaseous ammonia to flow into the mixing chamber 16 in the direction indicated by the arrows when its diaphragm mounted valving member 19 is unseated as a result of the vacuum created in the mixing chamber 16 as a result of the rapid flow of water through the orifice 15*a* and the throat member 11.

In the conventional ejector, such as the structure described thus far, the precipitate tends to accumulate in the throat 11 as a result of the ammonia-water mixing action occurring in the mixing chamber 16. This necessitates periodic dismantling of the unit for cleaning, and depending on water hardness, the period between cleanings may be as short as one or two days.

The present invention overcomes the problems associated with the mixing of ammonia with hard water. To this end, the apparatus of the present invention includes an ejector having means providing a self-cleaning function which greatly lengthens the time periods between inspection and cleaning of the mixing apparatus. As a result, the mixing apparatus of the present invention is capable of operating for prolonged periods of time to mix gaseous ammonia with hard water with minimal maintenance.

The present invention accomplishes the aforementioned object by providing an ejector having a flexible liner 20 on the inside of the bore in its throat member 11 and having means for periodically flexing the liner 20. As best seen in FIG. 1, the liner 20 is formed into a shape corresponding with the shape of the throat bore sections 11*a* and 11*b* so that the liner 20 normally lays flat against the inner periphery of the bore. The liner 20 is fabricated of a thin, flexible, elastic material such as rubber which is capable of repeatedly flexing, or stretching, from the normal full line position indicated in FIG. 1 into the flexed broken line position indicated therein and returning. A preferred material for the liner 20 is EPDM rubber of 0.050 inch thickness having a durometer of about 70 on the Shore A scale.

The liner 20 is removably secured in the throat member 11. For this purpose, the liner 20 in the illustrated embodiment has an upstream end 20*a* which is reversely turned around the upstream end 12 of the throat member 11 and clamped in place by an internally-threaded collar 22 which threadedly engages external threads on the upstream end 12 of the throat member 11. The downstream end 20*b* of the liner 20 is similarly secured by an internally-threaded collar 23 which threads onto external threads on the downstream end 13 of the throat member 11. Thus, the collars 22 and 23 clamp the liner 20 in place and form an expandable chamber 30 between the inner periphery of the throat bore sections 11*a* and 11*b* and the outer periphery of the liner 20. The collars 22 and 23 enable the liner 20 to be installed easily and removed readily in the event that replacement should become necessary.

Solid matter tending to form in the zone of mixing 16 as a result of the interaction of the minerals in the hard water with the ammonia tends to deposit on the inner periphery of the liner 20 in the throat member 11. When the liner 20 is flexed inwardly in the manner noted heretofore, the solid matter which has deposited on the inside of the liner 20 cracks due to the stretching of the liner 20 and is exfoliated into the flow stream. As a result, the solid matter is dislodged and expelled from the throat member 11 by the flowing mixture.

For the purpose of periodically flexing the liner 20 inwardly, means is provided for introducing a working fluid into the chamber 30 and for exhausting the same therefrom. In the present invention, the preferred working fluid is water which is admitted into and exhausted from the chamber 30 by a passageway 31 which opens into the chamber 30 at about the longitudinal median of the throat member 11. The passageway 31 is connected to a pipe 32 which in turn is connected to water under pressure greater than the pressure of the flowing gas-water mix in the throat 11 such as exists upstream of the ejector. Thus, water supplied under pressure to the chamber 30 causes the liner 20 to flex inwardly into the broken line position for dislodging solid particulate matter which may have accumulated on its inner periphery. After flexure of the liner 20, the water in the chamber 30 is dumped to a drain at atmospheric pressure via the passageway 31 and pipe 32. This enables the liner 20 quickly to return to its normal position as a result of its inherent elasticity and the pressure in the throat member 11 aoting against the inside of the liner 20. If desired, compressed air may be used as the working fluid in those installations where it is readily available.

Figure 2:
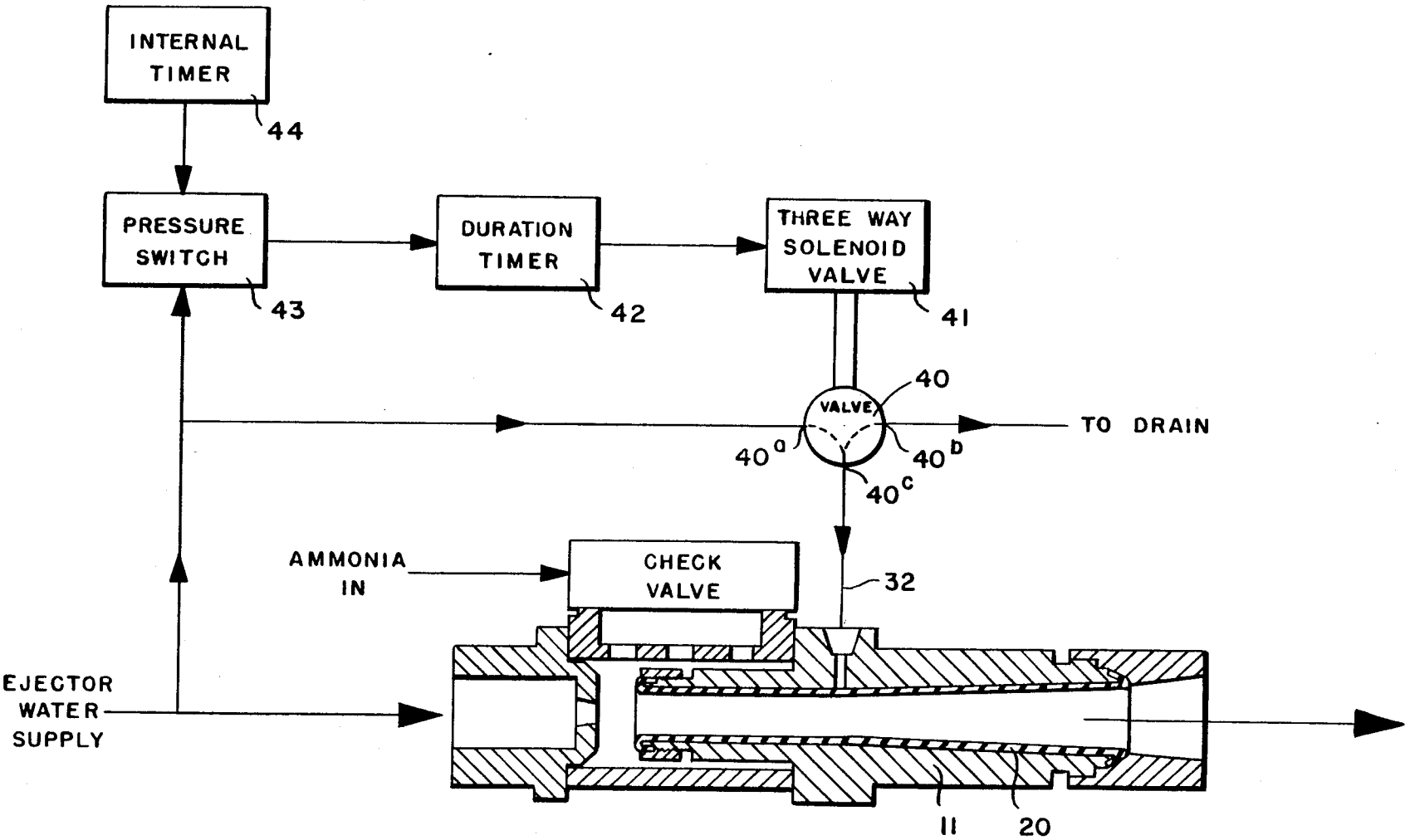
FIG. 2 is a schematic diagram illustrating a preferred control system for automatically cycling the self-cleaning mixing apparatus.

For the purpose of controlling the periodic inflow and outflow of water with respect to the expandable chamber 30, a control system is provided. As best seen in FIG. 2, the control system comprises a three-way valve 40 having an inlet port 40*a* connected to the water supply line upstream of the ejector inlet 15, an outlet port 40*b* connected to drain and a control port 40*c* which is connected alternately with the inlet 40*a* and the outlet 40*b*. The three-way valve 40 is activated by an electric actuator, or solenoid, 41 connected to a duration timer 42 and a pressure switch 43. An internal timer 44 is connected to the pressure switch 43, and all are connected to a suitable electric power supply. The pressure switch is connected to the water supply line upstream of the valve inlet 40*a* and operates to sense an increase in upstream water pressure for purposes to be described.

With the above referenced control system, the internal timer 44 operates, after a predetermined time interval, to supply a control signal to the valve actuator 41 for actuating the three-way valve to connect its inlet port 40*a* to its control port 40*c* and thereby to supply water to the expandable chamber 30 via the pipe 32. This causes the liner 20 to flex inwardly. Inward flexure of the liner 20 results in an increase in pressure in the water supply line upstream of the ejector as a result of the constriction of the flow through the throat member 11. The increase in pressure is sensed by the pressure switch 43 which, when a predetermined pressure level is reached, such as 20 psig. above normal water supply pressure, signals the valve actuator 41 to switch the three-way valve to connect its control port 40*c* with its drain port 40*b*. This causes the water contained in the expandable chamber 30 to flow outwardly to the drain as the liner 20 returns to its normal operating position. Thus, the pressure switch 43 functions to detect when the liner 20 has been flexed inwardly the desired amount by sensing the amount of flow constriction provided by the liner 20 and then producing a feedback signal for the valve actuator. Preferably, the internal timer 44 is set to cycle the valve 40 in a range of one-half to two hour intervals, and preferably once each hour.

In order to provide a back-up, or override, for the pressure sensing switch 43, the duration timer 42 signals the valve actuator 41 to drain the chamber 30 after a predetermined time interval has elapsed. Normally, the pressure switch 43 will actuate the valve 40 to dump the chamber 30 within one second of its opening. However, in the event that the pressure switch 43 does not operate within that time period, the maximum length of time that the liner 20 is flexed inwardly is limited to about one second as determined by the setting of the duration timer 42. Thus, if the pressure switch 43 does not signal the valve actuator 41 to dump the water from the expandable chamber 30 within one second, the duration timer 42 provides such a signal to the valve actuator 41.

In the illustrated embodiment of FIGS. 1 and 2, the pressure switch 43 and duration timer 42 each have a set of normally closed contacts connected in series to the valve actuator 41, and these contacts are, in turn, connected to the internal timer 44 and in a latching circuit. Thus, the internal timer 44 can power the actuator 41 through the normally closed contacts to initiate the liner flexure while either the pressure switch 43 or the duration timer 42 can open the normally closed contacts to actuate the valve 40 to dump water.

Figures 3, 4:
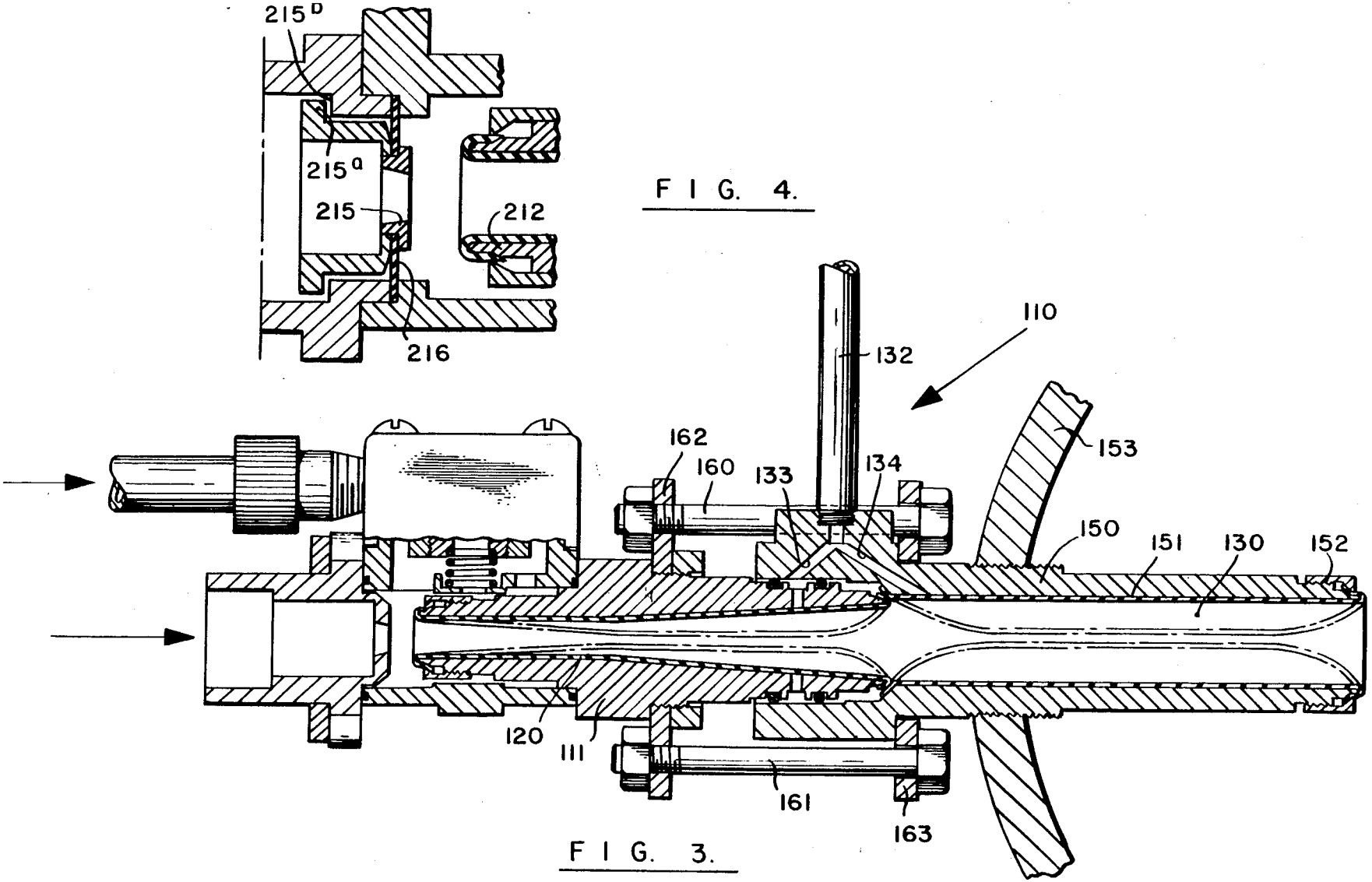
FIG. 3 is a longitudinal sectional view, similar to FIG. 1, but illustrating another embodiment of the present invention.
FIG. 4 is an enlarged framentary sectional view of a modified orifice assembly which is particularly suited for use in the apparatus of the present invention.

In certain very hard water situations, such as when the hardness of the water is in excess of about 240 ppm., and where it is desired to inject the ammonia water mixture directly into a water main, the apparatus of FIG. 1 may be modified in the manner illustrated in FIG. 3. As best seen therein, the apparatus 110 of FIG. 3 is similar to the apparatus 10 of FIG. 1 except that it also includes an elongated tubular extension 150 located downstream of the throat member 111. The tubular extension 150 has a flexible tubular liner 151 forming an expandable chamber 130, similar to the chamber 20 formed by the liner 20, which is clamped at its free end by a threaded collar 152 in much the same manner as the liner 20 is clamped in the embodiment of FIG. 1. The inner, or upstream, end of the liner 151 is clamped against the downstream end of the throat member 111 by the bolts 160, 161 extending through the yokes 162 and 163. The liner 151 is sufficiently flexible and elastic as to be capable of being flexed inwardly from the full line position illustrated in FIG. 3 into the broken line position illustrated therein in much the same manner as the liner 120 in the throat is flexed.

In this embodiment, both liners 120 and 151 are flexed inwardly substantially simultaneously by water supplied by a conduit 132 which is connected to a pair of flow passages 133 and 134 (FIG. 3). The passage 133 supplies water under pressure to flex the throat liner 120 inwardly. The passage 134 supplies water under pressure to flex the extension liner 151 inwardly. The supply pipe 132 is connected to the three-way valve 40 illustrated in FIG. 2.

When the control system of FIG. 2 actuates threeway valve 40, both the throat liner 120 and the extension liner 151 are flexed inwardly to loosen any solid matter which may have formed on their interiors. This allows the same to be ejected into the water main 153 along with the ammonia-water solution. Thus, the embodiment of FIG. 3 is well suited for those installations where the water is very hard and where direct injection into a water main is desirable. In this embodiment, it is preferable for the duration timer 42 to be set to about three (3) seconds to allow sufficient time for the two liners to be flexed the desired amount.

In order to prevent the excessive formation of precipitates adjacent to the mixing chamber 16 on the downstream side of the orifice in the embodiments of FIGS. 1 and 3, a modified orifice assembly may be provided. As best seen in FIG. 4, the modified orifice assembly comprises an orifice, or nozzle, 215 which is mounted centrally in a flexible annular diaphragm, or disc, 216 disposed adjacent the upstream end 212 of the throat member. The orifice 215 is mounted for limited axial movement toward and away from the upstream end of the throat member 11, the motion being limited to approximately 0.040 inches in the axial direction. This is accomplished by the engagement of the annular flange **215*a* of the orifice member 215 with the radial shoulder 215*b*** on the inside of the water inlet.

Under normal flow conditions, the differential in pressure across the orifice 215 causes it to move downstream toward the upstream end of the throat member until its flange **215*a* engages the shoulder 215*b*. However, when the throat liner 20 is flexed inwardly, pressure builds up rapidly at the upstream end of the throat and causes the diaphragm 216 to flex rapidly upstream, thereby causing any solid matter which may have formed about the orifice 215** to be dislodged.

In view of the foregoing, it should be apparent that the present invention now provides improved apparatus for mixing ammonia with hard water in a manner which reduces the frequency with which the mixing apparatus needs to be disassembled and cleaned. As a result, the apparatus of the present invention is capable of operating effectively for relatively long periods of time with minimal maintenance and downtime. Thus, the apparatus of the present invention is particularly well suited for use in those installations where it is desirable to eliminate water softeners as the source of water for ejectors used to mix ammonia with water prior to chlorination for avoiding formation of trihalomethanes.

While preferred embodiments of the present invention have been described in detail, various modifications, alterations and changes may be made without departing from the spirit and scope of the present invention as defined in the appended claims.

We claim:

1. Apparatus for mixing with a first flowing medium a second medium tending to form solid mattern having a proclivity to precipitate in the zone of mixing, said apparatus comprising:

a throat member having a through bore with an upstream end and a downstream end, first inlet means adjacent the upstream end of said throat member for flowing said first medium into said throat member bore, second inlet means between said first inlet means and said upstream end of said throat member for introducing said second medium into said first medium, an elastic tubular liner extending lengthwise in said throat member bore, means at opposite ends of said throat member securing said tubular liner in said throat member bore and defining an expandable chamber between the outer periphery of said liner and the inner periphery of said throat member bore with said chamber completely surrounding said liner between said throat member ends, and means for alternately admitting into and exhausting from said chamber a working fluid adapted to flex said liner periodically for stretching the liner inwardly and constricting flow through said throat and thereby increasing pressure of said first medium upstream of said first inlet means, means upstream of said first inlet means for sensing said increase in pressure, and means cooperable with said pressure sensing means to exhaust said working fluid from said chamber when a predetermined pressure level is sensed, whereby any precipitate forming on the inside of the throat liner is loosened and exfoliated into the mixed mediums flowing through the throat.

2. Apparatus according to claim 1 wherein said pressure sensing means includes a pressure switch connected to said valve actuating means and time delay means operable to cause said valve to exhaust said working fluid from said chamber after a predetermined time interval.

3. Apparatus according to claim 1 wherein said working fluid admitting and exhausting means includes a passage in said throat member opening laterally into said chamber, and valving means connected to said passage for admitting said working fluid into said chamber to flex the liner inwardly and for exhausting said working fluid from said chamber to allow said liner to return to its position normally engaged with the bore in said throat member, and means for actuating said valving means.

4. Apparatus according to claim 2 wherein said actuating means includes a timer connected to said valving means for causing the same to admit said working fluid into said chamber after a predetermined time interval.

5. Apparatus according to claim 1 including a tubular extension disposed downstream of said throat member in tandem therewith for receiving the mixed mediums flowing therethrough, a flexible tubular liner disposed on the inner periphery of said tubular extension and defining an expandable chamber therebetween, and means for periodically flexing said tubular extension liner for loosening any solid matter tending to accumulate therein.

6. Apparatus according to claim 5 wherein said tubular extension liner flexing means includes means connecting said tubular extension chamber to said working fluid admitting and exhausting means, whereby said throat liner and said extension liner are flexed in common by said working fluid.

7. Apparatus according to claim 1 wherein said throat member has a predetermined configuration and said flexible tubular liner has a like configuration causing it normally to engage the inner periphery of said throat member bore when mounted therein, and said securing means includes means clamping said liner to said throat member adjacent its upstream and downstream ends.

8. Apparatus according to claim 7 wherein said flexible tubular liner has upstream and downstream end portions reversely turned about the upstream and downstream ends of the throat member, and said securing means includes collars surrounding said liner end portions for clamping them to the throat member.

9. Apparatus according to claim 8 wherein said opposite ends of said throat member and said collars are threaded for releasably clamping said liner in said throat member bore to afford ready removal and replacement of said liner.

10. Apparatus according to claim 1 including an orifice member disposed coaxially with said throat member bore adjacent its upstream end, and flexible means mounting said orifice member for limited axial movement in opposite directions relative to the upstream end of said throat member.

11. Apparatus according to claim 10 wherein said flexible mounting means includes an annular diaphragm surrounding said orifice member and extending transversely across the path of flow of said first medium between said throat member and said first inlet means.

12. Apparatus according to claim 11 including means for engaging said orifice member to limit the axial movement thereof with respect to said throat member.

13. Apparatus for mixing gaseous ammonia with water containing minerals tending to form a solid precipitate, comprising:

an ejector having a throat with a first upstream inlet for water, a second inlet for ammonia, and a downstream outlet for ammonia and water, a flexible liner mounted in said throat, means at spaced upstream and downstream locations for mounting said liner in said throat and defining therewithin an expandable chamber completely surrounding said liner, said liner being fabricated of elastic material conforming to the shape of said throat for normally engaging its inner periphery, means for flexing said liner periodically inward and stretching it away from its normal throat engaging position, including means for supplying water under pressure to said ejector, conduit means providing fluid communication between said water supply means and said chamber, valve means connected to said conduit means for alternately supplying said water to and exhausting said water from said chamber, means for actuating said valve means at predetermined intervals to expand said chamber and thereby stretch said liner for loosening any solid precipitate deposited therein, said liner when stretched constricting water flow through said throat and increasing water pressure upstream of said ejector inlet, means for sensing said increase in upstream water pressure in response to said liner stretching and cooperating with said valve actuating means to exhaust said water from said chamber when a predetermined pressure level is reached.

14. Apparatus according to claim 13 including an orifice member disposed in said ejector upstream of said throat inlet, and flexible means surrounding said orifice member and mounting the same for movement upstream and downstream with respect to said throat inlet in response to a pressure increase caused by inward flexure of said liner, said movement of said orifice member loosening any solid precipitate that may have formed adjacent thereto.

15. Apparatus according to claim 13 including a tubular extension mounted downstream of said throat member in fluid conmunication therewith, a liner mounted in said tubular extension, and means connecting said valve means to said tubular extension for flexing said tubular extension liner when said throat member liner is being flexed, whereby precipitate is loosened from both the throat member and tubular extension.

16. Apparatus for mixing a first flowing medium with a second medium tending to form solid matter having a proclivity to precipitate in the zone of mixing, said apparatus comprising:

a throat member having a through bore with an upstream end and a downstream end, an orifice member disposed adjacent the upstream end of said throat member to define a mixing chamber therebetween, means mounting said orifice member for limited movement toward and away from the upstream end of said throat member, means providing an inlet for said first medium upstream of said orifice member, means providing an inlet for said second medium intermediate said orifice member and the upstream end of said throat member, a flexible tubular liner extending lengthwise in said throat member bore, a tubular extension disposed downstream of said throat member, a flexible tubular liner mounted inside said tubular extension, and means for flexing said liners periodically, whereby the movable orifice cooperates with the flexible liners to loosen any solid matter precipitate which may accumulate thereon.

17. Apparatus according to claim 16 wherein said orifice mounting means includes a flexible annular diaphragm surrounding said orifice member and disposed in spaced relation with the upstream end of said throat member.

18. Apparatus according to claim 16 wherein said liner flexing means includes conduit means for admitting a working fluid to and exhausting it from between said liners and the throat member bore and tube extension surrounding the liners, valve means connected to said conduit means, and means for actuating said valve means at predetermined time intervals.

19. Apparatus according to claim 18 including means connecting said conduit means upstream of said inlet means so that said working fluid is provided by said first medium, and wherein said valve means includes a three-way valve connected to said conduit means.

20. Apparatus according to claim 19 wherein said valve actuating means includes means for sensing pressure of said first medium upstream of said throat member, and means for actuating said valve means in response to a predetermined level of sensed pressure.

* * * * *